US007775020B2

(12) United States Patent
Marco

(10) Patent No.: US 7,775,020 B2
(45) Date of Patent: Aug. 17, 2010

(54) BAR CODE BLOCKING PACKAGE

(75) Inventor: Leslie S. Marco, Bloomingdale, IL (US)

(73) Assignee: Illinois Tool Works Inc., Glenview, IL (US)

( * ) Notice: Subject to any disclaimer, the term of this patent is extended or adjusted under 35 U.S.C. 154(b) by 415 days.

(21) Appl. No.: 11/799,040

(22) Filed: Apr. 30, 2007

(65) Prior Publication Data

US 2007/0267303 A1 Nov. 22, 2007

Related U.S. Application Data

(60) Provisional application No. 60/796,721, filed on May 2, 2006.

(51) Int. Cl.
*B65B 21/04* (2006.01)

(52) U.S. Cl. ..... 53/398; 53/446; 53/544; 53/176

(58) Field of Classification Search ..... 53/398, 53/446, 544, 176; 206/146, 147, 150, 151, 206/158, 161, 459.5; 198/379, 382, 394
See application file for complete search history.

(56) References Cited

U.S. PATENT DOCUMENTS

| | | | | |
|---|---|---|---|---|
| 3,415,350 | A * | 12/1968 | Murphy | 198/394 |
| 3,541,751 | A | 11/1970 | Quebe et al. | |
| 3,580,380 | A * | 5/1971 | Phillips | 198/376 |
| 4,207,221 | A | 6/1980 | Tobias et al. | |
| 4,431,693 | A | 2/1984 | Skukowski | |
| 4,827,114 | A | 5/1989 | Blachon | |
| 4,957,197 | A * | 9/1990 | Delapierre | 198/394 |
| 5,074,399 | A | 12/1991 | Kettle et al. | |
| 5,215,180 | A * | 6/1993 | Allard et al. | 198/395 |
| 5,492,222 | A | 2/1996 | Weaver | |
| 5,502,304 | A | 3/1996 | Berson et al. | |
| 5,544,749 | A | 8/1996 | Watts | |
| 5,667,071 | A | 9/1997 | Nakagoshi et al. | |
| 5,682,983 | A | 11/1997 | Weaver et al. | |
| 5,919,028 | A | 7/1999 | Edqvist | |
| 6,050,399 | A | 4/2000 | Pratt | |
| 6,234,945 | B1 | 5/2001 | Weaver | |
| 6,484,478 | B1 | 11/2002 | Arends et al. | |
| 6,598,738 | B2 | 7/2003 | Weaver | |

(Continued)

FOREIGN PATENT DOCUMENTS

EP 0 677 453 A1 10/1995

(Continued)

OTHER PUBLICATIONS

Co-pending U.S. Appl. No. 12/053,296, filed Mar. 21, 2008, entitled "Bar Code Blocking Package".

(Continued)

*Primary Examiner*—Hemant M Desai
(74) *Attorney, Agent, or Firm*—Pauley Petersen & Erickson

(57) ABSTRACT

A method and apparatus for blocking a bar code in a package includes a carrier with a plurality of apertures and an opaque section. The carrier is engaged with a plurality of containers so that a bar code on each container is rotationally oriented toward a center of the resulting package and is blocked by adjacent containers and/or the opaque section of the carrier from a bar code scanner.

8 Claims, 4 Drawing Sheets

U.S. PATENT DOCUMENTS

| | | | | |
|---|---|---|---|---|
| 6,688,465 | B2 | 2/2004 | Arends et al. | |
| 6,868,652 | B2 | 3/2005 | Arends et al. | |
| 6,880,313 | B1 | 4/2005 | Gessford et al. | |
| 7,237,671 | B2 * | 7/2007 | Chambers et al. ..... | 206/150 |

FOREIGN PATENT DOCUMENTS

| | | |
|---|---|---|
| EP | 0 812 780 | 12/1997 |
| GB | 2 225 566 | 6/1990 |
| WO | WO 96/11140 | 4/1996 |

OTHER PUBLICATIONS

Co-pending U.S. Appl. No. 12/053,363, filed Mar. 21, 2008, entitled "Single Color Bar Code Printing On A Multi-Package".
Co-pending U.S. Appl. No. 11/799,054, filed Apr. 30, 2007, entitled "Bar Code Blocking System".
Co-pending U.S. Appl. No. 11/799,041, filed Apr. 30, 2007, entitled "Bar Code Blocking Package".

* cited by examiner

BAR CODE BLOCKING PACKAGE

CROSS REFERENCE TO RELATED APPLICATION

This application claims the benefit of U.S. Provisional Application No. 60/796,721 filed on 02 May 2006.

BACKGROUND OF THE INVENTION

1. Field of the Invention

This invention relates to a package of containers that facilitates proper bar code scanning.

2. Description of Prior Art

Conventional container carriers are often used to unitize a plurality of similarly sized containers, such as cans, bottles, jars and boxes and/or similar containers. Flexible plastic ring carriers are one such conventional container carrier.

Flexible plastic ring carriers may be used to unitize groups of four, six, eight, twelve or other suitable groups of containers into a convenient multi-package. Typically, containers within the multi-package are individually coded with a universal product code ("UPC") label, referred to as a "bar code" herein that enables a bar code scanner to read product information, such as price. When such containers are placed within a multi-package such as a "six pack," difficulties may arise when container bar codes with individual container information are scanned instead of package bar codes with the information relevant to the multi-package or six pack.

Traditional multi-packages, such as six-packs, include containers that are positioned in random rotational orientations within the carrier. Each container generally includes an individual bar code which includes information, such as price, regarding the individual container. However, when the bar code for the individual container is scanned as the multi-package price, problems may arise for the vendor. Such problems primarily include a single container price being charged for a multi-container package and the inventory control problems that may result.

As such, it is desirable to block the bar codes of individual containers within a multi-package from the scanning process.

SUMMARY OF THE INVENTION

The present invention is directed to a package that includes a flexible carrier and a plurality of containers.

According to a preferred embodiment of this invention, a plurality of containers, such as cans, are positioned within a carrier so that each bar code is oriented inwardly or otherwise away from outer faces of the resulting package or otherwise oriented so that a bar code reader is less likely to read the bar code on each container.

The carrier of the present invention, although traditionally generally transparent, may additionally include an opaque section. The opaque section may extend through a center of the carrier and either on top of, underneath or between the generally flat sheet forming the carrier.

Accordingly, the plurality of containers are rotationally oriented in the carrier so that each bar code is positioned inwardly toward a center of the package and preferably toward an opaque section. Alternatively, containers may be rotationally oriented in the carrier in any other suitable manner such that a bar code scanner is less likely to read individual bar codes on the respective containers. The opaque section preferably prevents any light from the bar code scanner from contacting and reading the bar codes of the individual containers.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
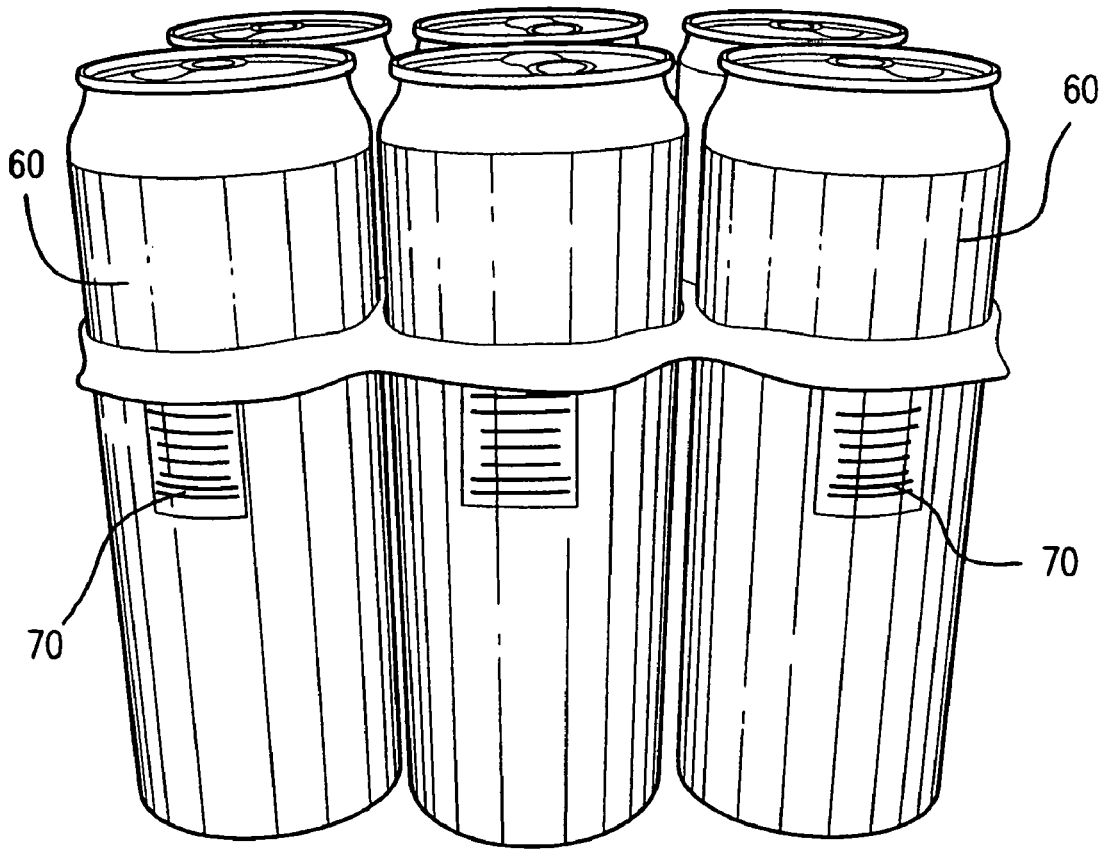
FIG. 1 PRIOR ART
FIG. 1 is a side view of a package of containers assembled in a conventional manner with individual bar codes in random rotational orientations.

FIG. 1 shows a package of six containers 60 unitized in a carrier to form a multi-packaging device. As shown, an exterior face of each container 60 includes a machine readable universal product code ("UPC"), referred to herein as bar code 70, printed thereon. Bar code 70 on each individual container 60 permits container 60 to be scanned by a bar code reader or scanner (not shown). When bar code 70 on container 60 is scanned by the bar code reader, information, such as the price, about the individual container 60 is retrieved from a computer connected with respect to the bar code reader. According to a preferred embodiment of this invention, the lines on bar code 70 are aligned in a generally horizontal orientation relative to container 60.

As shown in FIG. 1, a package of individual containers 60 comprises a unitized group of containers 20 sold as a package. The unitized containers 60 are generally randomly oriented so that each container 60 is positioned in a different and/or random rotational orientation within the carrier. The package may have a separate bar code (not shown in FIG. 1) which allows information about the package, such as the price of the group of containers 60, to be retrieved when the separate bar code is scanned by the bar code reader. This separate "package" bar code may be printed on the exterior of the package or otherwise affixed to the package by suitable means, such as adhesive.

However, problems and mis-scans may arise if the bar code reader instead scans bar code 70 of the individual containers 60 in lieu of the separate package bar code. Such mis-scans may result in a single container 60 price being charged for a multi-container package.

Figure 2:
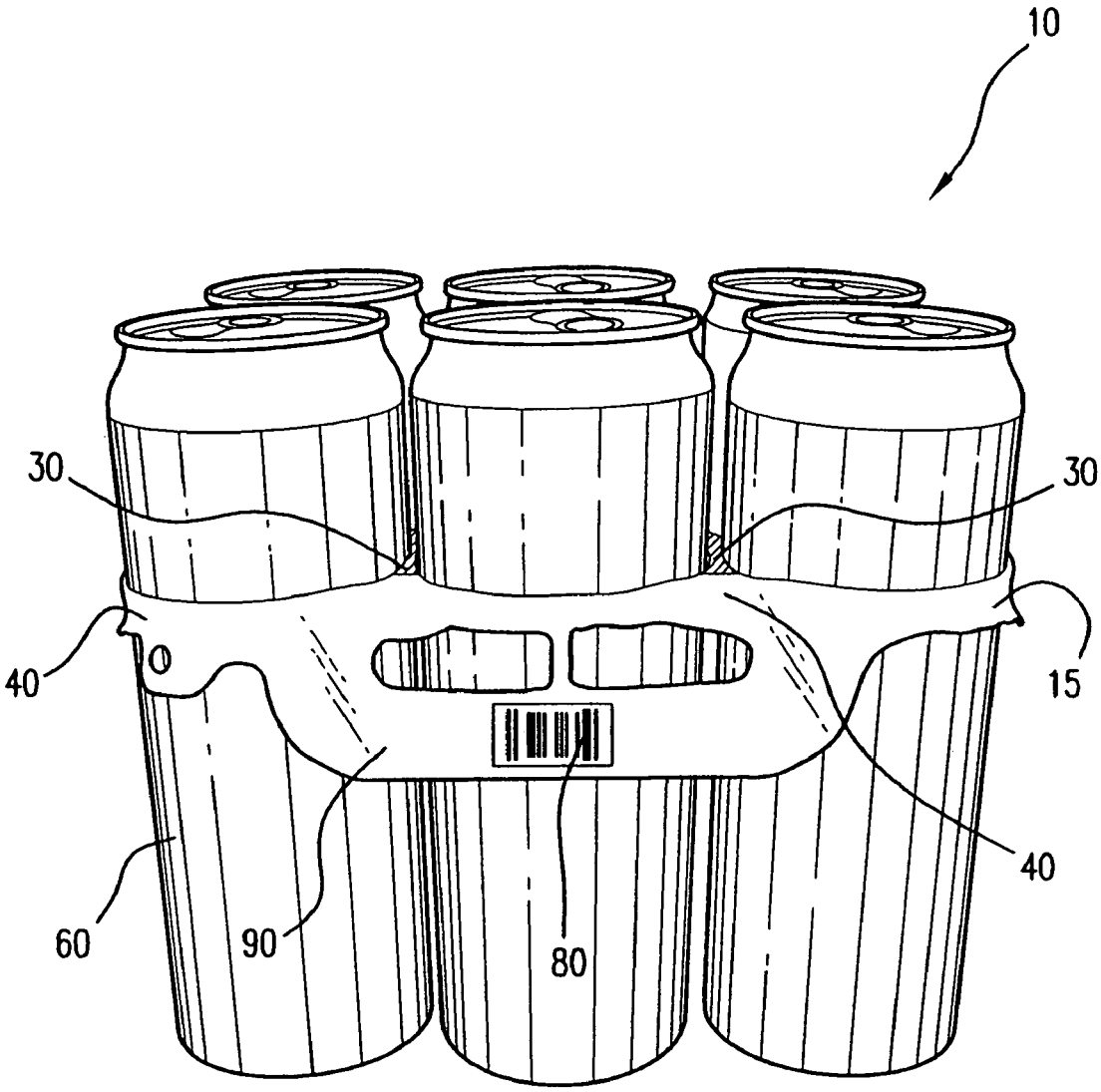
FIG. 2 is a side view of a package of containers according to one preferred embodiment of this invention.

FIG. 2 shows package 10 according to a preferred embodiment of this invention. As shown, package 10 may include a plurality of containers 60, such as cans, wherein each bar code 70 has been oriented into a preferably inward position relative to package 10. Although cans are shown in FIG. 2, bottles or any other commonly unitized container may be used in package 10 according to this invention. Containers 60 are preferably, though not necessarily, like-sized within a single flexible carrier 10.

Figure 3:
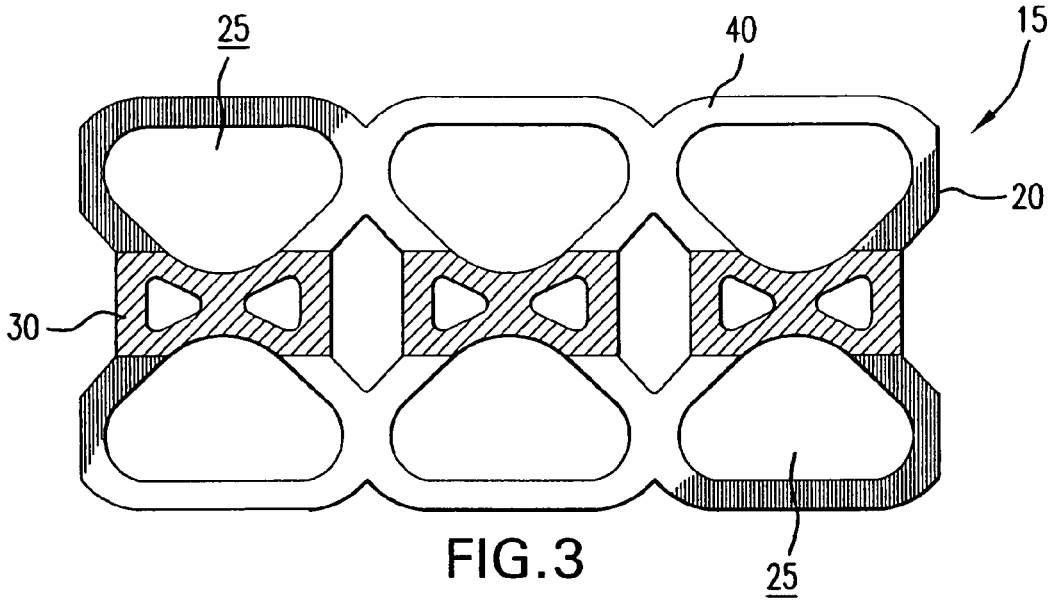
FIG. 3 is top view of a flexible carrier according to one preferred embodiment of this invention.

FIG. 3 shows carrier 15 according to a preferred embodiment of this invention. As described, carrier 15 is preferably a thermoplastic ring-type carrier, commonly called "six-pack" rings, that unitize a plurality of containers 60 into a single package 10.

Each carrier 15 preferably includes sheet 20 having a width and length defining therein a plurality of container receiving apertures 25, each for receiving a single container 60. The plurality of container receiving apertures 25 are preferably arranged in longitudinal rows and longitudinal ranks so as to form an array of container receiving apertures 25, such as two rows by three ranks for a six container multi-package, two rows by six ranks for a twelve container multi-package, etc. Container receiving apertures 25 are preferably elongated in a longitudinal direction of carrier 10.

Sheet 20 and thus carrier 15 of the present invention are preferably substantially transparent and made of a suitable plastic material, preferably formed in extruded sheets, such as low to medium density polyethylene. As shown in FIG. 3, carrier 15 preferably additionally includes opaque section 30. Opaque section 30 preferably comprises a material and/or treatment that results in a portion of sheet 20 that absorbs or reflects light beams emitted from the bar code reader so that the bar code reader cannot read bar codes 70 on containers 60 which are covered or obscured, at least partially, by carrier 15. As used herein, "opaque section" is defined as a portion of carrier 15 having a treatment, ingredient, feature and/or quality that does not permit light beams from a bar code reader to pass through carrier 15 and thus scan bar code 70.

As described, sheet 20 is formed of a generally transparent material and includes an array of container receiving apertures 25. Opaque section 30 preferably extends through sheet 20 to comprise carrier 15 of the subject invention. As shown in FIG. 3, opaque section 30 may extend through a center of carrier 15, either on top of, underneath or between sheet 20. As such, opaque section 30 may be adhered in sections or strips to sheet 20, such as with an adhesive; opaque section 30 may be applied to sheet 20, such as with a hot stamp, an ink or paint; and/or opaque section 30 may be manufactured into sheet 20, such as in a co-extrusion process.

According to one preferred method of manufacture, an ink is rolled along sheet 20 or a hot stamp is applied to sheet 20 prior to formation or stamping of apertures 25. As such, opaque section 30 may be formed along a generally central area of carrier 15 and between transversely adjacent apertures 25.

As shown in FIG. 3, opaque section 30 extends in a strip through a center portion of sheet 20 and generally between rows of apertures 25. According to this preferred embodiment of the invention, carrier 15 includes opaque section 30 extending parallel to and surrounded on two sides by transparent sections 40 of sheet 20. As such, rows of apertures 25 are positioned outside of opaque section 30. According to a preferred embodiment opaque section 30 extends less than 180 degrees or halfway around each aperture 25. As a result, opaque section is not formed along the outer portions or transverse extremities of sheet 20.

Figure 4:
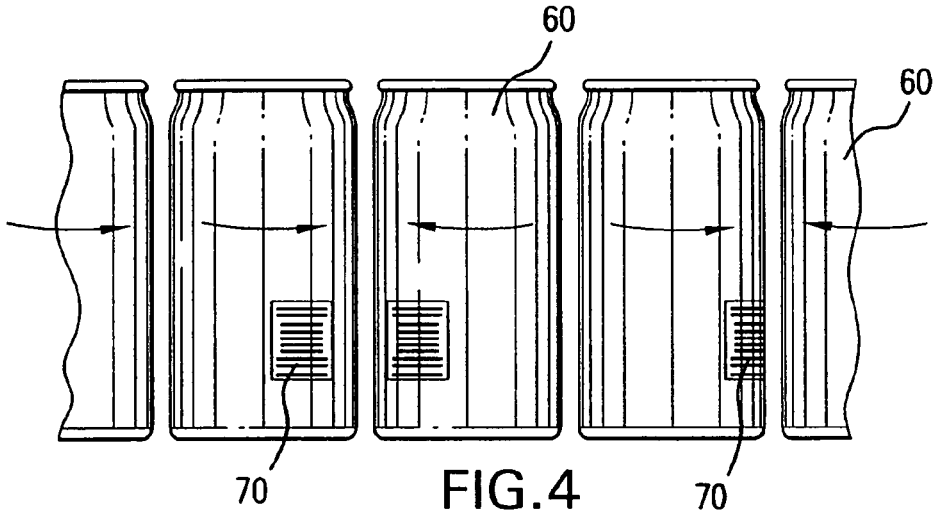
FIG. 4 is a side view of a plurality of containers during orientation according to one preferred embodiment of this invention.

According to a preferred embodiment of this invention, such as shown schematically in FIG. 4, the plurality of containers are rotationally oriented in the corresponding array of apertures so that each bar code 70 is positioned so that a bar code reader cannot scan each bar code 70. According to a preferred embodiment of this invention, each bar code 70 is rotationally positioned inwardly toward opaque section 30 and a center of a resulting package 10. However, opaque section 30 may be intermittently applied and/or positioned throughout carrier 15 based upon a desired location of bar code 70 on oriented containers 60. In any desirable configuration, each container 60 within carrier 15 is rotationally oriented within carrier 15 so that bar code 70 is obstructed by an adjacent container 60 and/or by opaque section 30.

Figure 5:
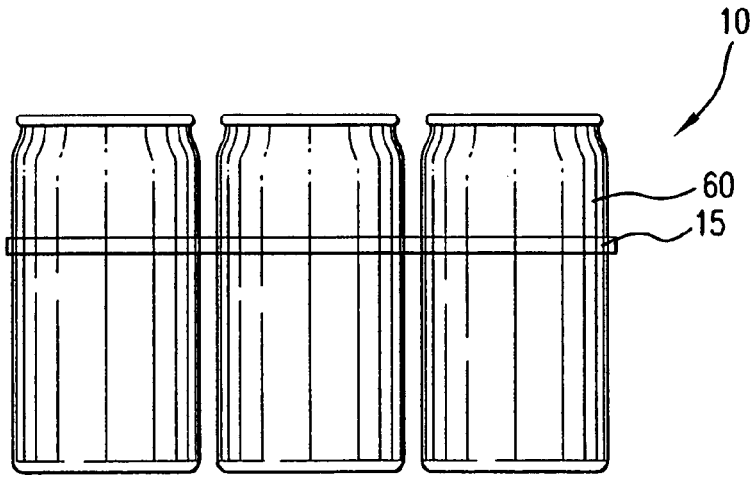
FIG. 5 is a side view of a package according to one preferred embodiment of this invention.
Figure 6:
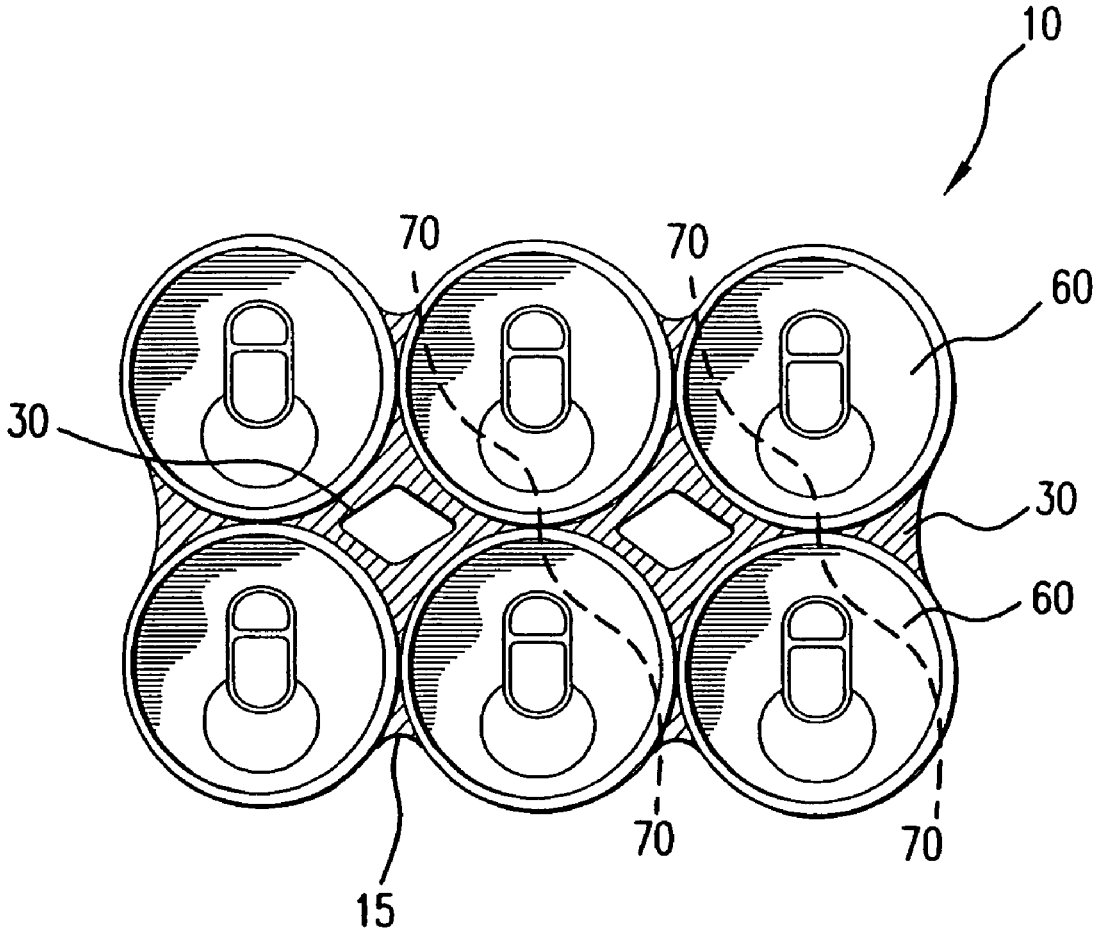
FIG. 6 is a top schematic view of a package similar to the package shown in FIG. 5.

As shown in FIGS. 5 and 6, bar codes 70 are preferably oriented inwardly so that bar code 70 of each container 60 faces a bar code 70 of each transversely adjacent container 60. As such, adjacent containers 60 may be oriented so that the bar code reader cannot scan bar code 70. In addition, or alternatively, opaque section 30 may prevent any light from bar code scanner, whether directly or reflectively from contacting and reading bar code 70 of the individual containers 60. In part, opaque section 30 preferably visually obstructs bar code 70 on each container 60.

As shown in FIG. 2, carrier 15 is preferably applied around a sidewall of each respective container 60. As such, opaque section 30 preferably directly overlaps with at least one line of each bar code 70 on each container 60.

According to one preferred embodiment of this invention, a second bar code 80 (or "multi-package code") may be positioned on handle 90, such as shown in FIG. 2, or other portion of package 10. The second bar code 80 may include information regarding the multi-package including new pricing and quantity information. Opaque section 30 thereby provides a dual role of blocking bar codes 70 on individual containers 60 and supporting the second bar code for multi-package labeling.

FIG. 4 is a schematic representation of orienting individual containers 60 to result in the described invention. Individual containers 60 may be rotated, either manually or mechanically, into a preferred orientation before, during and/or after engaging carrier 15 with individual containers 60. According to a preferred embodiment of this invention, and as shown in FIG. 4, randomly oriented containers are oriented prior to application of carrier 15 to individual containers 60. Rotation of containers 60 once engaged within carrier 15 may destroy the integrity of carrier 15 through excessive torque applied to the respective thermoplastic rings within carrier 15. Alternatively, rotation of containers 15 maybe impossible once containers 60 are sealed within other packages contemplated by this invention and/or known to those having ordinary skill in the art.

Various desirable methods of orienting individual containers 60 are taught by Arends et al., U.S. Pat. No. 6,484,478; Arends et al., U.S. Pat. No. 6,688,465; and Arends et al., U.S. Pat. No. 6,868,652, which are each incorporated herein by reference.

According to a preferred method of the subject invention, carrier 15 having a plurality of container receiving apertures 25 and opaque section 30 is provided for engagement with a plurality of containers 60. Containers 60 are then positioned within carrier 15 and are oriented so that bar code 70 of each container 60 is blocked by adjacent containers 60 and/or opaque section 30 of carrier 15. As described in the Arends et al. Patents, incorporated herein be reference, each container 60 may be oriented before it is positioned within carrier 15; after container 60 is positioned within carrier 15 or some combination of orienting containers 60 before and after engagement with carrier 15.

According to one desired embodiment of this invention, each container 60 is oriented, prior to engagement with carrier 15, so that each bar code 70 faces a corresponding bar code 70 in a transversely adjacent container 60. Carrier 15 is then applied to a desired set of containers 60 resulting in a unitized package 10.

In addition, opaque section 30, though desirable to apply prior to engagement of carrier 15 to containers 60, may be applied after application of carrier 15 to containers 60. As described in more detail above, opaque section 30 may be adhered as a strip to carrier 15; may be marked in a strip along carrier 15; or may otherwise be inserted on or in carrier 15 before, during or after the application of carrier 15 to containers 60.

While in the foregoing specification this invention has been described in relation to certain preferred embodiments thereof, and many details have been set forth for purpose of illustration, it will be apparent to those skilled in the art that package is susceptible to additional embodiments and that certain of the details described herein can be varied considerably without departing from the basic principles of the invention.

The invention claimed is:

1. A method of assembling a plurality of containers in a multi-packaging device so that individual bar codes on each container of the plurality of containers are not generally readable by a bar code reader, the method comprising:

providing a carrier having a plurality of apertures, transparent sections and an opaque section into engagement with the plurality of containers, the opaque section extending along a center portion of the carrier and between the transparent sections;

positioning the plurality of containers within the carrier; and orienting each container of the plurality of containers before the container is positioned within the carrier so that a bar code of each container is blocked by the opaque section of the carrier.

2. The method of claim 1 further comprising:

positioning the plurality of containers within the carrier so that the carrier engages a sidewall of each container of the plurality of containers.

3. The method of claim 1 further comprising:

orienting each container so that each bar code faces a corresponding bar code in a transversely adjacent container.

4. The method of claim 1 further comprising:

adhering a strip of the opaque section to the carrier.

5. The method of claim 1 further comprising:

marking a strip of the opaque section on the carrier.

6. The method of claim 1 further comprising:

co-extruding the opaque section within the carrier.

7. A method of blocking bar codes within a unitized package of containers so that individual bar codes on each container are not generally readable by a bar code reader, the method comprising:

providing a carrier having a plurality of apertures into engagement with the plurality of containers, the carrier including an opaque section extending along a center portion of the carrier between transparent sections; and rotationally orienting each container of the plurality of containers within the carrier so that a bar code of each container is at least partially blocked by the opaque section of the carrier and is not readable by the bar code scanner and so that each bar code is blocked by another container of the plurality of containers.

8. The method of claim 7 further comprising:

orienting each container so that each bar code faces a corresponding bar code in a transversely adjacent container.

* * * * *